United States Patent [19]

Kourimsky

[11] 4,214,223

[45] Jul. 22, 1980

[54] FUSE

[75] Inventor: Friedrich J. A. Kourimsky, Bensheim, Fed. Rep. of Germany

[73] Assignee: AMP Incorporated, Harrisburg, Pa.

[21] Appl. No.: 922,264

[22] Filed: Jul. 6, 1978

[30] Foreign Application Priority Data

Jul. 7, 1977 [GB] United Kingdom ..... 28454/77

[51] Int. Cl.[2] ..... H01H 85/04

[52] U.S. Cl. ..... 337/293; 337/231; 337/295

[58] Field of Search ..... 337/290–297, 337/241, 227, 158, 231, 401, 412, 414, 416

[56] References Cited

U.S. PATENT DOCUMENTS

| | | | |
|---|---|---|---|
| 1,925,060 | 8/1933 | Stephenson | 337/278 |
| 3,832,664 | 8/1974 | Wiebe | 337/241 |
| 4,149,137 | 4/1979 | Konnemann | 337/290 X |

*Primary Examiner*—R. L. Moses

*Attorney, Agent, or Firm*—Allan B. Osborne

[57] ABSTRACT

A fuse comprises a thin metal strip of constant thickness mounted on an insulating support and having relatively wide portions mutually spaced apart and interconnected by a relatively narrow portion constituting a fusible link which overlies a recess or aperture in the support so that the fusible link is spaced apart from the support surface. Preferably, the strip is folded about one end of the support with the fusible link remote from the fold, the relatively wide portions extending around the fold on each side of the support to constitute tab contacts for mating with a receptacle.

9 Claims, 3 Drawing Figures

FUSE

The invention relates to fuses.

A known fuse comprises a metal part having relatively wide and thick, spaced apart, side portions connected by a relatively narrow and thin fusible link mounted on an insulating carrier.

A disadvantage of the known fuse is that the fusible link must be produced by machining away portions of the metal to relatively precise tolerances to provide a reliable electrical characteristic which is a relatively time consuming and expensive operation.

An object of the invention is to provide a fuse which has reliable electrical characteristics but which is economical to manufacture.

According to the invention the fuse comprises a thin metal strip of constant thickness having relatively wide, spaced apart, side portions connected by a relatively narrow fusible link, the strip being mounted on an insulating support having a recess or aperture underlying the fusible link so that the fusible link is spaced from the surface of the support.

The metal strip can be manufactured by a simple stamping operation, the electrical characteristics being determined by the width of the fusible link which can be kept to the necessary tolerances without difficulty.

Another known fuse comprises a conductive layer printed onto an insulating board. However, with this process, the board material provides a heat sink under the fusible link and may both deteriorate and effect the electrical characteristics of the fuse, particularly with high currents, as a result of the heating effect. Attempts to remove board material underneath the fusible links (e.g. by grinding) would prove costly as they are time consuming and must be carried out with great precision.

According to another aspect of the invention the fuse comprises a thin metal strip of constant thickness having a slot extending to locations adjacent a pair of opposite ends of the strip to define relatively wide, spaced apart, side portions connected by relatively narrow fusible links at the ends, the strip being reversely folded along a line transverse to the slot and attached to opposite directed faces of an insulating support one end of which is received within the fold so that the side portions of the strip adjacent the fold line define tab contacts for mating with receptacle contacts on a fuse board the supports having a recess or aperture underlying each fusible link so that the fusible links are spaced from surfaces of the support.

An example of a fuse according to the invention will now be described with reference to the accompanying drawings in which.

Figure 1:
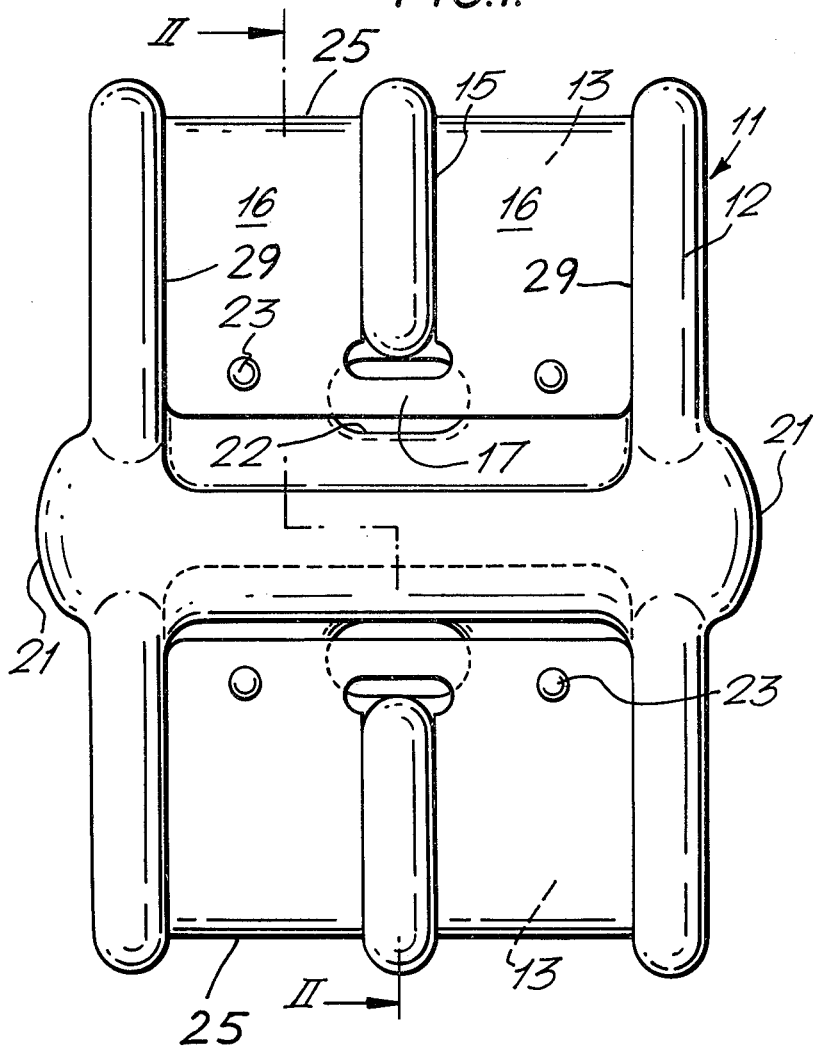
FIG. 1 is a front elevational view of the fuse.
Figure 2:
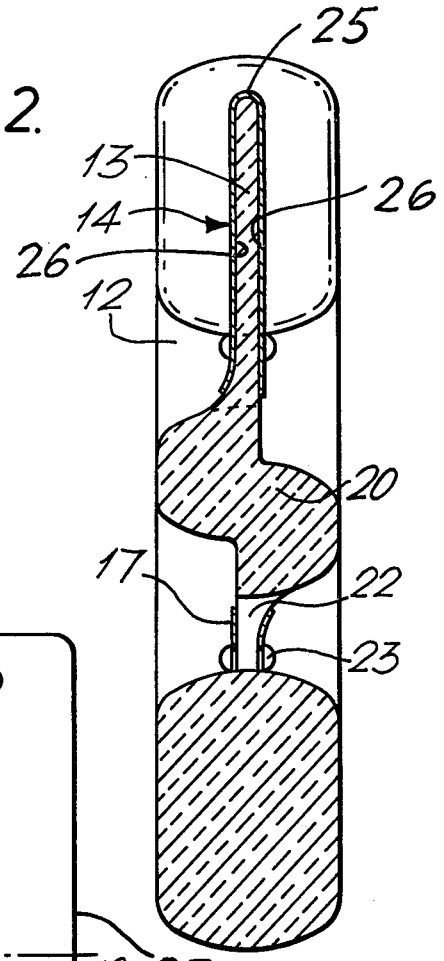
FIG. 2 is a cross-sectional view taken along line 2—2 of FIG. 1; and, FIG. 3 is a plan view of a blank of a metal strip of the fuse.
Figure 3:
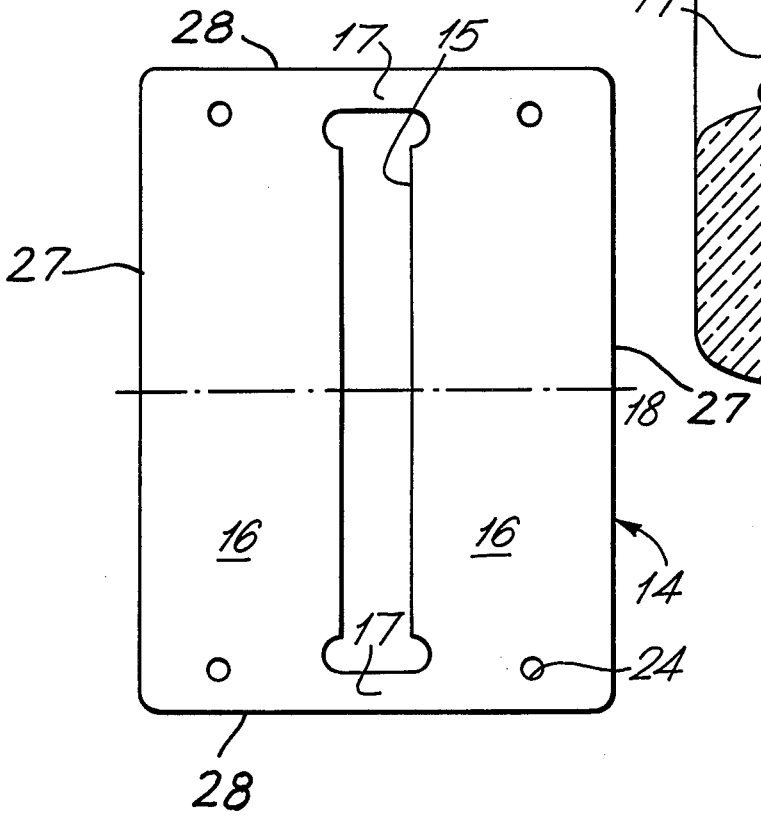

As shown in FIGS. 1 and 2, an integral transparent glass support 11 comprises a generally H-shaped rib 12 between opposite limbs of which extend a pair of platforms 13. A pair of thin zinc strips 14 of constant thickness (0.15 mm, 0.006 in.) each have a central slot 15 extending to opposite ends of the strip to define relatively wide, spaced apart, side portions 16 connected by relatively narrow fusible links 17 at the ends. Each strip is reversely folded along a line 18 transverse to the slot and the strips are attached by studs 23 and/or bonded to the oppositely directed faces of the respective platforms 13 with the platforms received within respective folds so that the side portions 16 define tab contacts adjacent the fold line. The studs protrude from opposite faces of the platforms and are received in apertures 24 in the strip. The heads of the studs are then deformed to retain the strip in situ. The platforms are formed with apertures 22 under the fusible links so that the links are spaced from surface portions of the support to ensure consistent fuse characteristics. The transverse portion 20 of the rib comprises a magnifying lens enabling an enlarged image of either fusible link to be seen through the transverse portion. A protuberance 21 is provided on opposite ends of the rib for handling purposes.

Alternatively, the support may be moulded from a suitable plastics material.

The fuse may be economical to manufacture as the metal strips may be produced by a simple stamping technique and manually folded around the support.

However, the fuse has reliable characteristics as the fusible links are spaced apart from the support surface which does not therefore provide a heat sink, the effect of which may vary according to the electrical load.

It will be apparent in the foregoing paragraph that the specific embodiment of the invention disclosed herein comprises two fuses, each of which has an insulating support and a conductor 14. The insulating support for each fuse has oppositely directed back-to-back conductor supporting surface portions, shown at 26 in FIG. 2, and these surface portions extend to the leading end 25 of each fuse, the leading end being the end which is inserted into the fuse receptacle. The support further comprises side edges which are defined by the portions 29 of the H-shaped rib 12. The conductor 14 has side edges 27, parallel spaced-apart end edges 28, and the opening 15 which extends between the end edges and parallel to the side edges 27. The portions 17 of the conductor thus serve as fusible links, while the portions 16 serve as terminal areas which are contacted by complementary terminal means.

What is claimed is:

1. A fuse comprising a thin metal strip of constant thickness having a slot extending to locations adjacent a pair of opposite ends of the strip to define relatively wide, spaced apart, side portions connected by relatively narrow fusible links at the ends, the strip being reversely folded along a line transverse to the slot and attached to oppositely directed faces of an insulating support one end of which is received within the fold so that the side portions of the strip adjacent the fold line define tab contacts for mating within receptacle contacts on a fuse board the supports having a recess or aperture underlying each fusible link so that the fusible links are spaced from surfaces of the support.

2. A fuse according to claim 1 in which the insulating support is a ceramic (e.g. glass), a portion of which adjacent the fuse links is transparent.

3. A fuse according to claim 1 in which the insulating support is moulded from a suitable plastics material.

4. A fuse according to any one of claims 1 to 3 in which the support is provided with a handling rib which protrudes from the oppositely directed faces of the support adjacent the fusible links and which comprises a magnifying lens adapted to enable an enlarged image of a link to be seen through the rib.

5. A fuse according to any one of claims 1 to 3 in which the other end of the insulating support is received within a fold of another, similar, metal strip arranged in back-to-back relation and spaced from the one metal strip.

6. A fuse according to claim 5 in which the support is provided with an H-shaped rib between opposite limbs of which extend two platforms respectively supporting the metal strips.

7. A fuse according to any one of claims 1 to 3 in which the or each strip is attached to the support by studs extending from opposite faces of the support and received in respective apertures provided in the or each strip.

8. A fuse comprising an insulating support and a conductor supported on said support, said support comprising a relatively thin rectangular member having a leading end and parallel side edges extending from said leading end, two oppositely directed back-to-back conductor supporting surface portions on said support, said conductor supporting surface portions extending from said leading end between said side edges partially along said support, said conductor comprising a generally rectangular sheet metal member having parallel spaced-apart side edges and parallel spaced-apart end edges, said sheet metal member having an enclosed elongated opening extending parallel to, and midway between said side edges, said member being folded along a fold line which extends parallel to, and midway between, said end edges and normally of said opening, said conductor having a U-shaped profile as folded, comprising a bight and plate-like sections extending from said bight, said conductor being fitted over said leading end of said support, said plate-like sections being supported by said supporting surfaces, said leading end being received in said bight and said side edges of said conductor extending parallel to said side edges of said support, said plate-like sections on each side of said opening being terminal areas for said fuse, portions of said plate-like sections which extend between said opening and said end edges being fusible links of said fuse.

9. A fuse as set forth in claim 8, said support having openings therein extending therethrough proximate to said fusible link.

* * * * *